US005208078A

United States Patent [19]

Ishibashi et al.

[11] Patent Number: 5,208,078

[45] Date of Patent: May 4, 1993

[54] METHOD OF PAINT APPLICATION BY ELECTROSTATIC SPRAYING

[75] Inventors: Ichirou Ishibashi; Yoshio Tomioka; Toshio Kubota; Niichi Toyama, all of Sayama, Japan

[73] Assignee: Honda Giken Kogyo Kabushiki Kaisha, Tokyo, Japan

[21] Appl. No.: 722,195

[22] Filed: Jun. 27, 1991

[30] Foreign Application Priority Data

Jul. 6, 1990 [JP] Japan ..... 2-179306

[51] Int. Cl.[5] ..... B05D 1/04; B05B 15/02

[52] U.S. Cl. ..... 427/483; 427/421; 239/3; 239/112; 118/302

[58] Field of Search ..... 427/27, 421, 483, 475; 239/3, 112; 118/302

[56] References Cited

U.S. PATENT DOCUMENTS 4,337,282 6/1982 Springer ..... 239/112
4,792,092 12/1988 Elberson et al. ..... 239/3
4,879,137 11/1989 Behr et al. ..... 427/27
4,884,752 12/1989 Plummer ..... 239/112
4,932,589 6/1990 Diana ..... 427/27

FOREIGN PATENT DOCUMENTS 2-2885 1/1990 Japan .

*Primary Examiner*—Shrive Beck
*Assistant Examiner*—Katherine A. Bareford

[57] ABSTRACT

Disclosed herein is a method of paint application. This method has the following advantageous effects. More specifically, when different paint is used, desired paint is alternately supplied to a first paint feeder and a second paint feeder from a paint feed source thereby to enable efficient painting of a workpiece by a spray gun. On the other hand, when the same paint is used, the paint is supplied only to the first paint feeder without using the second paint feeder, thereby making it possible to reduce wastefully-discharged paint and to efficiently carry out any cleaning work.

6 Claims, 4 Drawing Sheets

10
14
80
78
63
76
74
68
72
66
70
FROM 73
65
69
46
16
44
18
38
50
52
20
19
21
22
36
54
56
59
64
62
33
35
48
40
32
24
26
42
60
30c
30a
30d
30e
30b
34
12
58
28

10
14
80
78
63
74
76
68
72
66
70
FROM73
65
69
16
44
46
18
38
20
19
36
50
54
52
56
21
22
59
62
64
33
35
48
24
26
32
40
42
60
34
30a
30b
30c
30d
30e
12
28
58

METHOD OF PAINT APPLICATION BY ELECTROSTATIC SPRAYING

BACKGROUND OF THE INVENTION

1. Field of the Invention

The present invention relates to a method of applying paint to a workpiece wherein the painting can efficiently be carried out with electrostatic spraying.

2. Description of Related Art

There have heretofore been used various types of painting apparatuses having color changeover functions with a view toward carrying out efficient and speedy painting work using electrically conductive coatings or paints where the colors differ one to the other. One of such painting apparatuses is disclosed in Japanese Laid-Open Patent Publication No. 2-2885, for example. More specifically, the disclosure comprises a paint feed source for feeding a plurality of different paints, first and second paint reservoirs selectively supplied with paints through electrically insulated paint feed means, a first cleaning means for cleaning the paint feed means after the paints are fed to the first and second paint reservoirs, a second cleaning means for cleaning the other of both reservoirs while the paints are being delivered from one of them, a third cleaning means for cleaning paint delivery means used to deliver the paints to a coater, i.e., a spray gun from the respective first and second paint reservoirs, etc.

In the above-described conventional apparatus, the paints are alternately supplied to the first and second paint reservoirs from the paint feed source. In addition, the electrically-insulated paint feed means, the first and second paint reservoirs and the paint delivery means are cleaned by the first through third cleaning means each time the paints are delivered from the respective first and second paint reservoirs.

However, the above cleaning work is carried out even when the same paint is supplied to the first and second paint reservoirs, thereby causing a problem that usable and expensive paint is wastefully discharged.

Further, the apparatus has changeover valves for selecting either one of two discharges of the paint from the first and second paint reservoirs, and the like. However, there are parts of the apparatus, which are difficult to clean, for example the changeover valves or the like at the time of the cleaning work, so that the cleaning liquid is required in large quantities.

SUMMARY OF THE INVENTION

It is a general object of the present invention to provide a method of applying paint to a workpiece wherein any paint can be used as economically as possible.

It is a principal object of the present invention to provide a method of applying paint to a workpiece wherein the coating can continuously be carried out with electrically conductive paint, and particularly the same paint can reliably and efficiently be used.

It is another object of the present invention to provide a method of paint application, comprising the steps of feeding desired paint to a first paint feeder from a grounded paint feed source through a first feed line having an electrically-insulated portion formed in at least one portion thereof, cleaning and drying the electrically-insulated portion of the first feed line thereby to electrically insulate the paint feed source from the first paint feeder, thereafter feeding the paint to a spray gun from the first paint feeder thereby to carry out a painting process and then supplying paints different from the first paint to a second paint feeder from the paint feed source through a second feed line having an electrically-insulated portion formed in at least one portion thereof, cleaning and drying the electrically-insulated portion of the second feed line thereby to electrically insulate the paint feed source from the second paint feeder, feeding the different paints to the spray gun from the second paint feeder thereby to carry out a painting process, feeding paints only to the first paint feeder from the paint feed source through the first feed line in a state in which the second paint feeder is deactivated without causing the paint feed source to communicate with the second feed line when the same paint as the paint referred to above are used, cleaning and drying the electrically-insulated portion of the first feed line thereby to electrically insulate the paint feed source from the first paint feeder, and thereafter feeding the paint to the spray gun from the first paint feeder thereby to carry out a painting process.

It is a further object of the present invention to provide the method wherein when the same paint is used, a directional control valve having an inlet to which the paint feed source and flush valves are connected and an outlet to which the first and second feed lines are connected is actuated to intermittently feed the same paint to the first paint feeder from the paint feed source through the first feed line.

It is a still a further object of the present invention to provide the method wherein when the same paint is employed, the paint is supplied through the first feed line to the first paint feeder from the paint feed source, and thereafter the flush valves which communicate with the electrically-insulated portion of the first feed line are actuated to clean and dry only the electrically-insulated portion, thereby electrically insulating the paint feed source from the first paint feeder.

It is a still further object of the present invention to provide the method wherein when different paint is used, first and second on-off valves coupled to the same pressurized-air feed source are actuated so as to be alternately opened and closed, thereby alternately activating the first and second paint feeders which communicate with the first and second on-off valves respectively so as to feed the different paint in the first and second paint feeders to the spray gun.

It is a still further object of the present invention to provide the method wherein when different paint is used, the paint is fed to the spray gun from the first paint feeder so as to carry out the painting process, and thereafter the different paint is supplied to the second paint feeder from the paint feed source.

The above and other objects, features and advantages of the present invention will become apparent from the following description and the appended claims, taken in conjunction with the accompanying drawings in which a preferred embodiment of the present invention is shown by way of illustrative example.

DETAILED DESCRIPTION OF THE PREFERRED EMBODIMENTS

Figure 1:
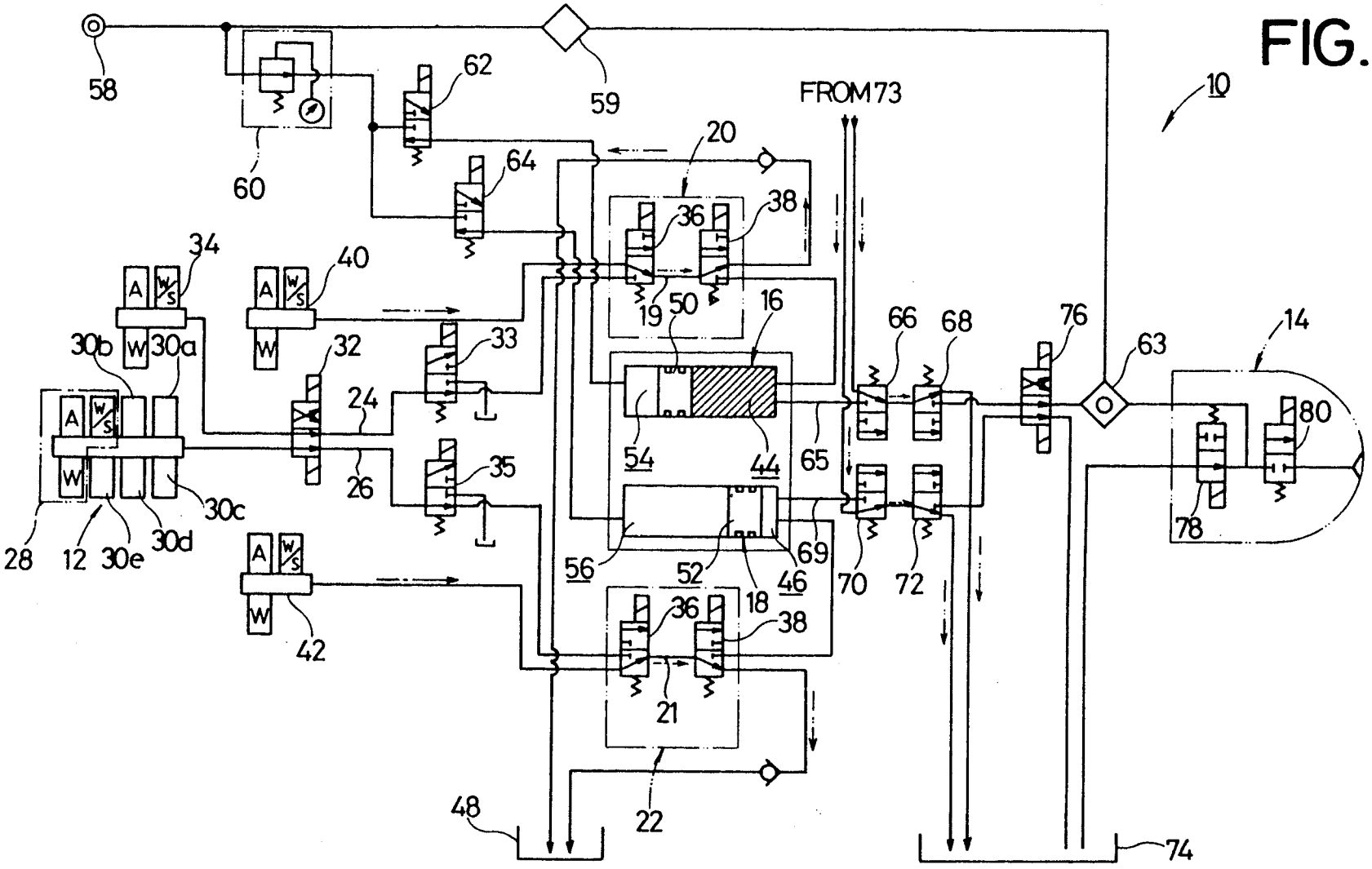
FIGS. 1, 2, 3 and 4 are schematic diagrams for describing operations of painting apparatuses each used to carry out a method of applying paint to a work according to one embodiment of the present invention.

Referring to FIG. 1, a painting apparatus 10 is provided for carrying out a method of applying paint to a workpiece according to one embodiment of the present invention. The painting apparatus 10 comprises a color changeover valve mechanism 12 serving as a grounded paint feed source for selectively supplying a plurality of different paints, first and second paint feeders 16, 18 used to temporarily store therein paint supplied from the color changeover valve mechanism 12 so as to alternately supply the respective paint stored therein to a spray gun 14, and first and second feed lines 24, 26 provided between the color changeover valve mechanism 12 and the first paint feeder 16 and between the color changeover valve mechanism 12 and the second paint feeder 18, respectively, and having electrically insulated lines 19, 21 formed in at least parts of the first and second feed lines 24, 26 respectively, the first and second feed lines 24, 26 in which first and second block valve mechanisms 20, 22 inclusive of the electrical insulated lines 19, 21 are interposed respectively.

The color changeover mechanism 12 has a first flush valve 28 for controlling the supply of air (A), water (W) and solvent (S) or the like, and a plurality of paint valves 30*a* through 30*e* capable of supplying different paints. In addition, the color changeover mechanism 12 can communicate with the first and second feed lines 24, 26 through a directional control valve 32 and first and second dump valves 33, 35. A second flush valve 34 is coupled to the directional control valve 32.

Each of the first and second block valve mechanisms 20, 22 have changeover valves 36, 38. The first feed line 24 and a third flush valve 40 are coupled to an inlet of the changeover valve 36 of the first block valve mechanism 20, whereas the second feed line 26 and a fourth flush valve 42 are coupled to an inlet of the changeover valve 36 of the second block valve mechanism 22. On the other hand, a storage chamber 44 of the first paint feeder 16 and a tank 48 are coupled to an outlet of the changeover valve 38 of the first block valve mechanism 20, whereas a storage chamber 46 of the second paint feeder 18 and the tank 48 are coupled to an outlet of the changeover valve 38 of the second block valve mechanism 22.

The first and second paint feeders 16, 18 have pistons 50, 52, respectively. An air feed source 58 communicates with a chamber 54 separated from the storage chamber 44 by the pistons 50 through a flow control valve 60 and an on-off valve 62, whereas it also communicates with a chamber 56 separated from the storage chamber 46 by the piston 52 through the flow control valve 60 and an on-off valve 64. In addition, the air feed source 58 is coupled to a paint flow control device 63 for controlling the pressure of air through a booster 59. The flow control device 63 permits an improvement in controllability of the delivery rate of paint.

A first trigger valve 66 and a third dump valve 68 coupled to a first delivery line 65 are disposed between the first paint feeder 16 and the spray gun 14, whereas a second trigger valve 70 and a fourth dump valve 72 coupled to a second delivery line 69 are disposed between the second paint feeder 18 and the spray gun 14. A fifth flush valve 73 for controlling the supply of air (A) and solvent (S) is coupled to respective inlets of the first and second trigger valves 66, 70, whereas a tank 74 and a directional control valve 76 are coupled to respective outlets of the third and fourth dump valves 68, 72.

A tank 74 is directly coupled to an outlet of the directional control valve 76 whereas the spray gun 14 is coupled to the outlet of the directional control valve 76 through the flow control device 63. The spray gun 14 has a fifth dump valve 78 and a third trigger valve 80, and is coupled to an unillustrated high-voltage applying means.

A description will now be made of operations of the painting apparatus constructed as described above to which the painting method according to the present embodiment is applied.

Figure 2:
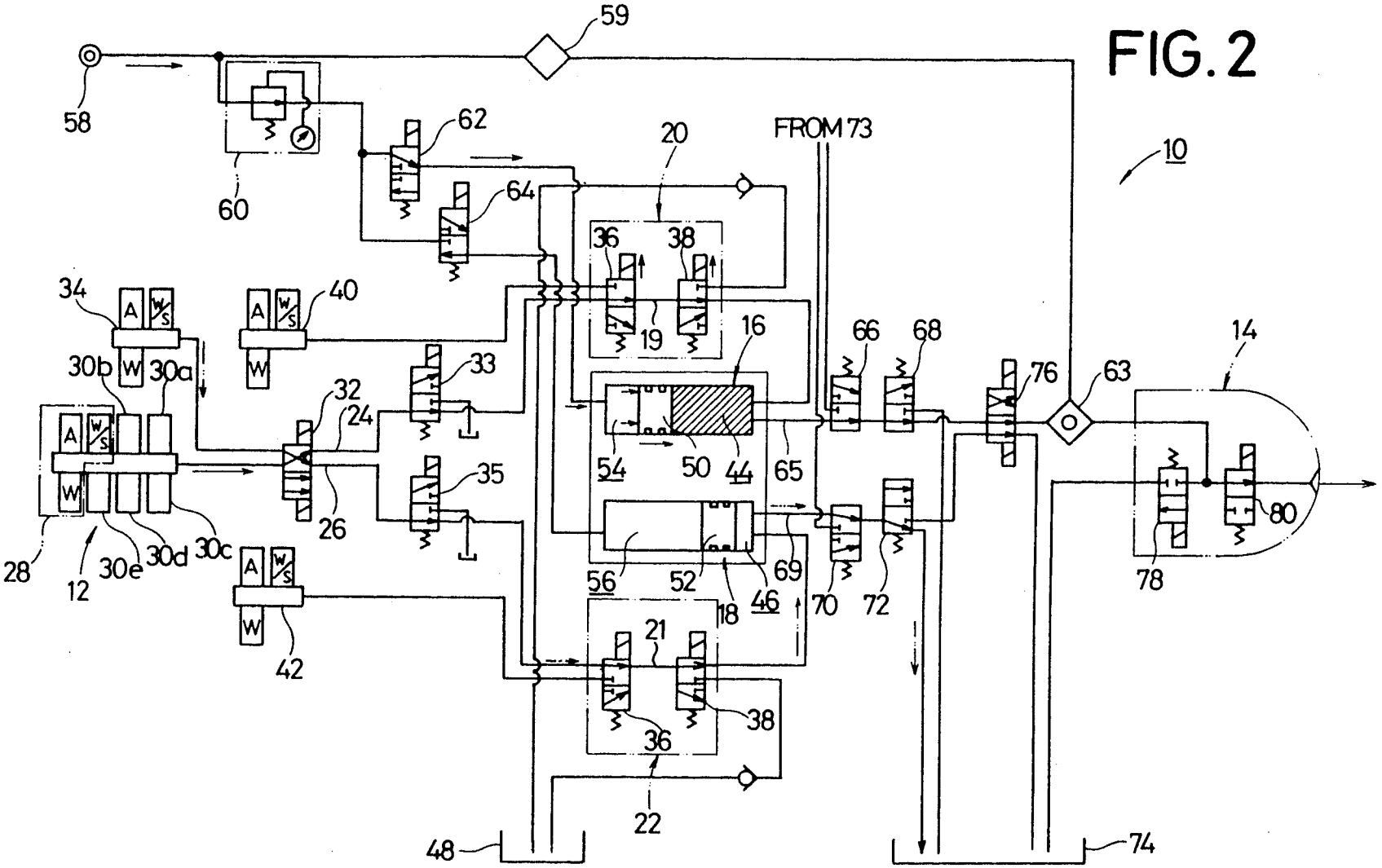

As shown in FIG. 2, paint of predetermined colors, which are pressure-fed from the paint valve 30*a* of the color changeover valve mechanism 12 to the directional control valve 32, pass through the first block valve mechanism 20 through the first feed line 24 starting from the directional control valve 32. Then, the storage chamber 44 of the first paint feeder 16 is charged with the paint referred to above, and thereafter the spray gun 14 is also filled with the paint through the first delivery line 65. The third trigger valve 80 is in a closed state upon charging of the spray gun 14 with the paint, and the fifth dump valve 78 is in an open state. After the charging of the spray gun 14 with the paint is completed, the fifth dump valve 78 is closed.

Then, the changeover valves 36, 38 of the first block valve mechanism 20 are actuated so as to be changed to the directions indicated by the arrows. The third flush valve 40 is actuated to clean the changeover valves 36, 38 of the first block valve mechanism 20 and lines coupled thereto, after which liquid used to clean them is discharged into the tank 48. In addition, the first block valve mechanism 20 is dried, thereby making it possible to electrically insulate the first paint feeder 16 from the color changeover valve mechanism 12 through a liquid removing process.

Then, drive air is supplied from the air feed source 58 to the chamber 54 of the first paint feeder 16 through the flow control valve 60 and the on-off valve 62. When the piston 50 is displaced toward the storage chamber 44, paint is applied to a work (not shown) under the action of the third trigger valve 80 in a state in which a high voltage is applied thereto.

When paint which is different in color from the paint referred to above is used, the first dump valve 33 is actuated so as to be changed to a desired direction, the color changeover valve mechanism 12 and the first feed line 24 are cleaned under the action of the first flush valve 28. Thereafter, the first dump valve 33 is returned to the original position.

Figure 3:
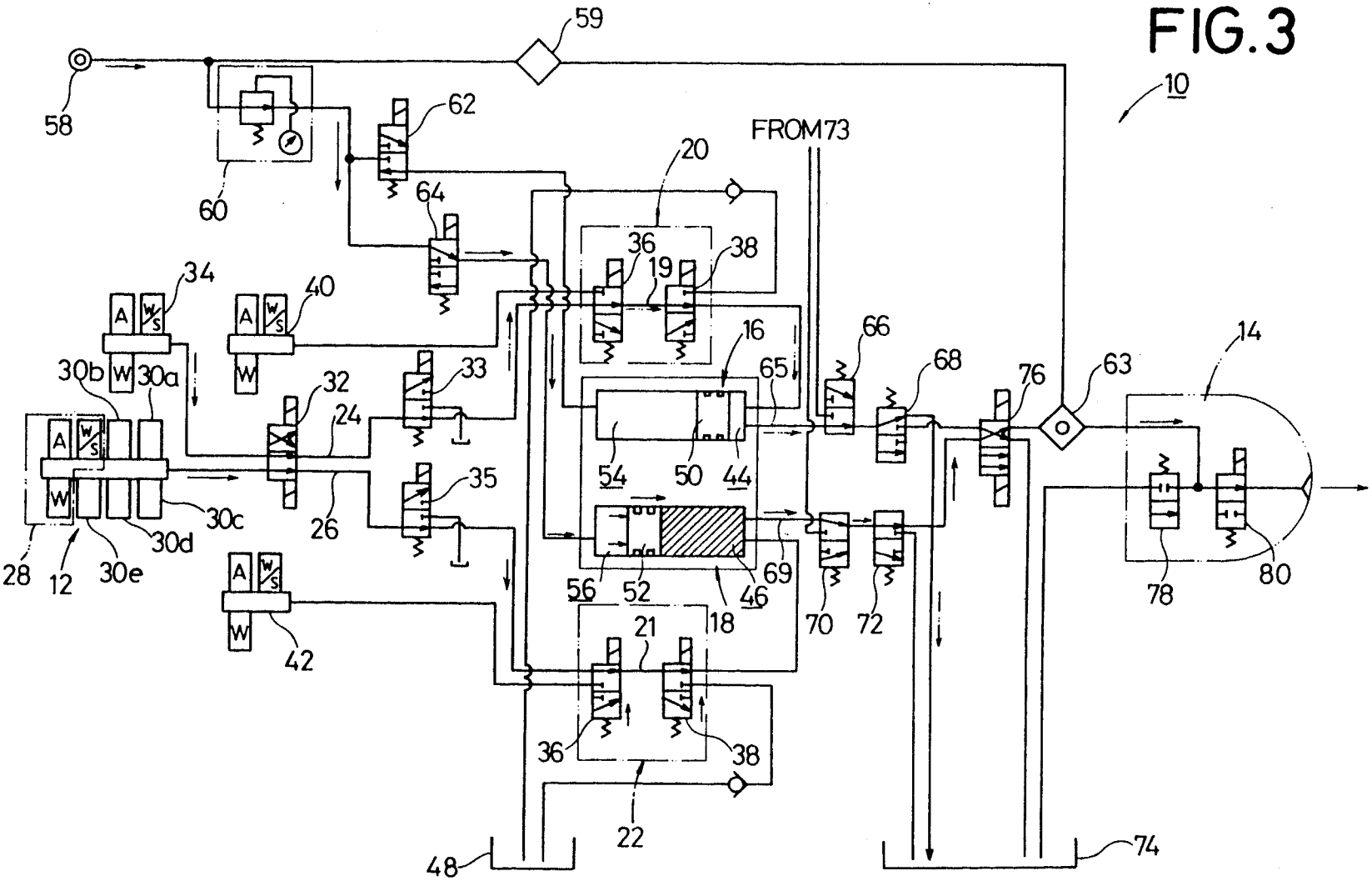

After the above-described painting is completed, the fifth flush valve 73 is actuated to clean a section from the first trigger valve 66 to the spray gun 14 through the third dump valve 68 and the directional control valve 76, with respect to the first delivery line 65. As shown in FIG. 3, the directional control valve 32, is then actuated, and the above different paint first passes through the directional control valve 32 and the second block valve mechanism 22 via another paint valve 30*b* of the color changeover valve mechanism 12 and is supplied to the storage chamber 46 of the second paint feeder 18. In addition, the directional control valve 76 is actuated so as to fill the spray gun 14 with the paint from the storage chamber 46 through the second delivery line 69, the second trigger valve 70 and the fourth dump valve 72. Incidentally, the fifth flush valve 73 supplies air to each of the first trigger valve 66, the third dump valve 68 and the directional control valve 76 in parallel with the process of charging the spray gun 14 with the paint, thereby drying the first delivery line 65. Thereafter, the direction of the third dump valve 68 is changed.

Figure 4:
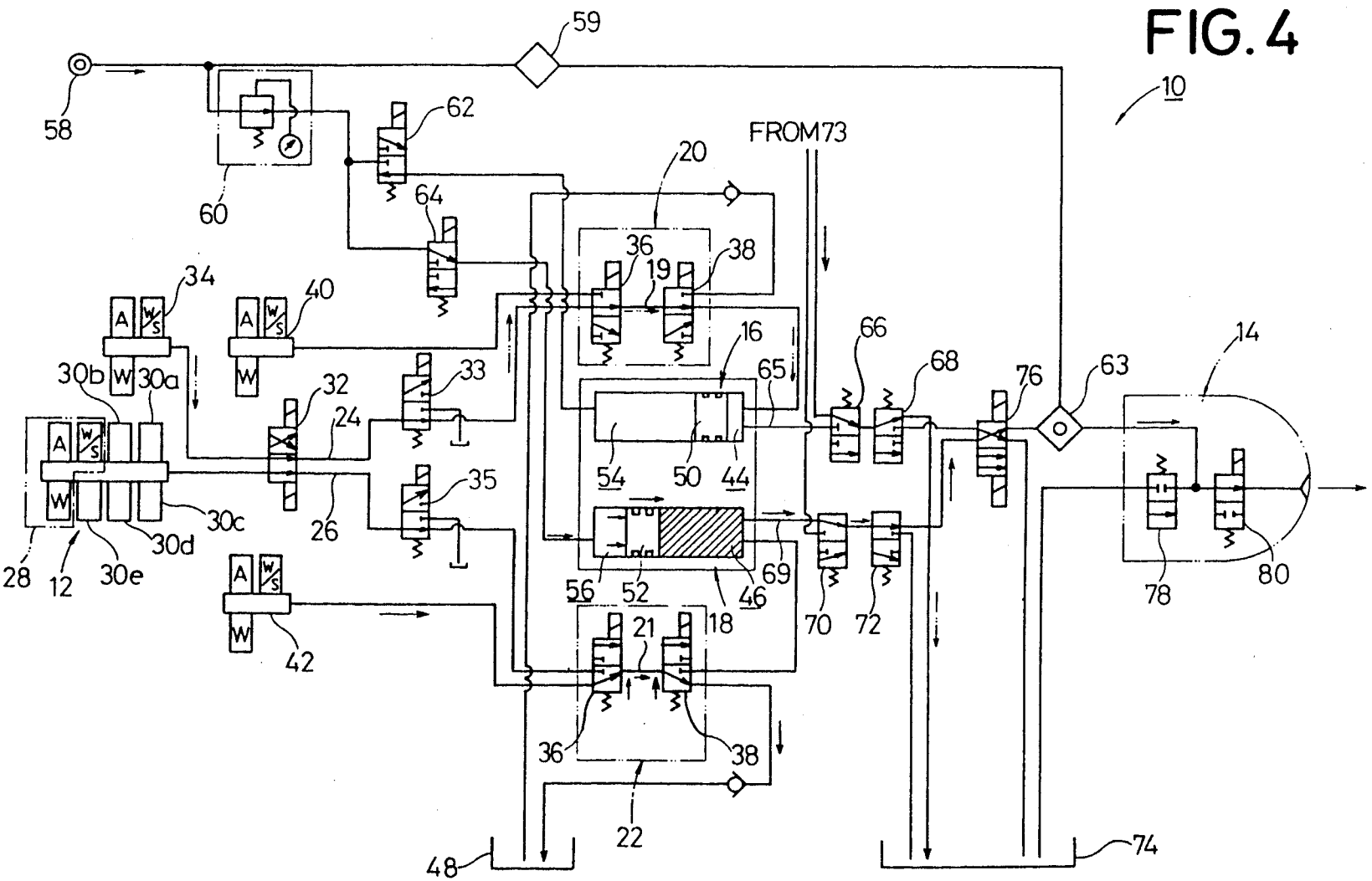

The changeover valves 36, 38 of the second block valve mechanism 22 are actuated to clean the second block valve mechanism 22 under the action of the fourth flush valve 42 after which liquid used to clean it is discharged into the tank 48. Thereafter, the second block valve mechanism 22 is dried, thereby electrically insulating the color changeover valve mechanism 12 from the second paint feeder 18 (see FIG. 4).

Then, the drive air is supplied to the chamber 56 of the second paint feeder 18 from the air feed source 58 through the flow control valve 60 and the on-off valve 64 so as to displace the piston 52 toward the storage chamber 46, thereby supplying the paint in the storage chamber 46 to the spray gun 14 through the second trigger valve 70, the fourth dump valve 72 and the directional control valve 76. Then, the third trigger valve 80 is actuated to apply the paint, to which a high voltage is applied, to the work (not shown).

While the painting is being carried out, the second flush valve 34 is actuated to clean the first delivery line 65 extending from the first feed line 24 to the third dump valve 68 through the first dump valve 33, the first paint feeder 16 and the first trigger valve 66 (see FIG. 3). Further, when paint having colors differ one to the other are used, the first flush valve 28 is actuated to clean the second feed line 26 extending to the second dump valve 35, and the directional control valve 32 in parallel with the cleaning process referred to above.

Incidentally, even when the paint with a different colors is used, the supply of the paint to the inside of the first paint feeder 16 is not carried out until the painting process carried out through the second paint feeder 18 is completed. The reason for this is that the time at which air is brought into contact with the paint between the first paint feeder 16 and the first trigger valve 66 of the first delivery line 65 is prevented from being prolonged. When the paint is brought into contact with the air and about 10 seconds elapse, solidified portions are produced therebetween, thereby developing mechanical trouble. In addition, operation programs of the painting apparatus can be simplified by making use of the control method referred to above.

On the other hand, when the same paint as referred to above is used, the supply of the paint to the second paint feeder 18 is not performed. More specifically, the spray gun 14 is released from being subjected to the high voltage. Then, the same paint is supplied to the first paint feeder 16 from the paint valve **30*a* as mentioned above, and the spray gun 14 is filled with the paint (see FIG. 2). In this case, the changeover valve 38 is switched over to discharge, through a check valve, air which remains in the first block valve mechanism 20 into the tank 48 from a dump path. Thereafter, the changeover valve 38 is switched again so as to supply the paint to the first paint feeder 16, thereby making it possible to prevent air from entering into the first paint feeder 16. After the cleaning and drying processes of the first block valve mechanism 20 are carried out, the paint is supplied to the spray gun 14 from the first paint feeder 16**, thereby completing the painting work.

In the present embodiment, paint with a different color is supplied to each of the first paint feeder 16 and the second paint feeder 18 upon use of a paint different in color, and the first paint feeder 16 and the second paint feeder 18 are alternately operated, thereby making it possible to efficiently carry out the painting work.

On the other hand, when the same paint is used as described above, the second paint feeder 18 is not used, and only the first paint feeder 16 is operated. Thus, one group of the first feed line 24, the first paint feeder 16 and the first delivery line 65 and another group of the second feed line 26, the second paint feeder 18 and the second delivery line 69 are not cleaned alternately for each painting as in the case where the first and second paint feeders 16 and 18 are alternately used. Therefore, the paint which remains between the color changeover valve mechanism 12 and the spray gun 14, can reliably be prevented from being discharged wastefully. In particular, expensive top coatings or paints can efficiently be used.

Further, only the first block valve mechanism 20 may be cleaned for each painting. Thus, the quantity of cleaning liquid used for the cleaning process can be reduced at one stroke.

As described above, the painting method according to the present invention has the following effects and advantages.

When the different paint is used, desired paint is alternately supplied to the first paint feeder and the second paint feeder, thereby enabling efficient painting work by the spray gun. In addition, the time at which the paint is subjected to air can be made as short as possible so as to prevent any trouble from occurring, and the operation programs of the painting apparatus can be simplified. On the other hand, when the same paint is used, the second paint feeder is not used, and the paints are supplied only to the first paint feeder, thereby making it possible to reduce wastefully-discharged paint and to efficiently carry out the cleaning work.

Having now fully described the invention, it will be apparent to those skilled in the art that many changes and modifications can be made without departing from the spirit or scope of the invention as set forth herein.

What is claimed is:

1. A method of paint application, comprising the steps of:

feeding a desired paint to a first paint feeder from a grounded paint feed source through a first feed line having an electrically-insulated portion formed in at least one portion thereof;

cleaning and drying said electrically-insulated portion of said first feed line thereby to electrically insulate said paint feed source from said first paint feeder;

thereafter feeding paints to a spray gun from said first paint feeder thereby to carry out a painting process with said paint;

cleaning a second paint feeder without supplying paint to said second paint feeder while said painting process with said paints is being carried out;

after said painting process with said paint has been completed, feeding desired paint to said second paint feeder from said paint feed source through a second feed line having an electrically-insulated portion formed in at least one portion thereof;

cleaning and drying said electrically-insulated portion of said second feed line thereby to electrically insulate said paint feed source from said second paint feeder; and feeding said paint to said spray gun from said second paint feeder thereby to carry out a painting process with said paint.

2. The method of paint application according to claim 1, wherein a first and second paint feeders comprise pistons therein for insulating paint storage chambers of said first and second paint feeders from air.

3. A method of paint application, comprising the steps of:

feeding a desired first paint to a first paint feeder from a grounded paint feed source through a first feed line having an electrically-insulated portion formed in at least one portion thereof;

cleaning and drying said electrically-insulated portion of said first feed line thereby to electrically insulate said paint feed source from said first paint feeder;

thereafter feeding said first paint to a spray gun from said first paint feeder thereby to carry out a painting process with said first paint;

wherein in a subsequent painting process, paint different from said first paint is used, said method further comprising the steps of:

cleaning a second paint feeder without supplying a second paint to said second paint feeder while said painting process with said first paint is being carried out;

after said painting process with said first paint has been completed, feeding said second paint to said second paint feeder from said paint feed source through a second feed line having an electrically-insulated portion formed in at least one portion thereof;

cleaning and drying said electrically-insulated portion of said second feed line thereby to electrically insulate said paint feed source from said second paint feeder; and feeding said second paint to said spray gun from said second paint feeder thereby to carry out a painting process with said second paint.

4. The method of paint application according to claim 3, wherein said first and second paint feeders comprise pistons therein for insulating paint storage chambers of said first and second paint feeders from air.

5. The method of paint application according to claim 3, wherein, in a subsequent painting process, paint which is the same as said first paint is used, said method further comprising the steps of:

cleaning a second paint feeder without supplying of said first paint to said second paint feeder while said painting process with said first paint from said first paint feeder is being carried out;

following completion of said painting process with said first paint feeder, resupplying said first paint to said first paint feeder from said paint feed source through said first feed line;

cleaning and drying said electrically-insulated portion of said first feed line thereby to electrically insulate said paint feed source from said first paint feeder; and again feeding said first paint of said spray gun from said first paint feeder thereby to carry out a painting process with said first paint from said first paint feeder.

6. The method of paint application according to claim 5, wherein said first and second paint feeders comprise pistons therein for insulating paint storage chambers of said first and second paint feeders from air.

* * * * *